United States Patent [19]

Ullman

[11] 4,036,362

[45] July 19, 1977

[54] PACKAGE

[75] Inventor: John E. Ullman, Huntingdon Valley, Pa.

[73] Assignee: Huntingdon Industries Incorporated, Bethayres, Pa.

[21] Appl. No.: 563,667

[22] Filed: Mar. 31, 1975

Related U.S. Application Data

[63] Continuation-in-part of Ser. No. 404,642, Oct. 9, 1973, Pat. No. 3,890,763.

[51] Int. Cl.[2] ..... B65D 65/14; B65D 65/38; B65B 53/00

[52] U.S. Cl. ..... 206/432; 206/497; 53/305; 53/48

[58] Field of Search ..... 206/497, 432, 45.33, 206/386; 53/305, 48

[56] References Cited

U.S. PATENT DOCUMENTS

| | | | |
|---|---|---|---|
| 3,411,265 | 11/1968 | Carpenter et al. | 206/497 |
| 3,478,950 | 11/1969 | Stevens | 206/45.33 |
| 3,587,839 | 6/1971 | Von Brecht | 206/497 |
| 3,589,510 | 6/1971 | Begnaud | 206/45.33 |
| 3,610,412 | 10/1971 | Morse | 206/497 |
| 3,687,282 | 8/1972 | Owen | 206/45.33 |

*Primary Examiner*—William Price
*Assistant Examiner*—Douglas B. Farrow
*Attorney, Agent, or Firm*—Smith, Harding, Earley & Follmer

[57] ABSTRACT

A package for articles such as cans, bottles, and the like, comprising a corrugated paperboard tray, a film sheet covering said articles, and an adhesive connecting opposite ends of said film sheet to opposed walls of said tray. The sheet may be heat shrunk to hold said articles to the tray and have opposed fully or partially closed ends which overlap the sides of the articles. The sheet may be stretch film that does not require heat shrinking, or it may be plain paper. The package may include an inverted top tray, with or without holes that receive the tops of the articles, to keep the articles in vertical alignment. The package may be double tier.

2 Claims, 27 Drawing Figures

35
37
213
211
215
219
221
217
199
207
49
193
195
91
197
191
61A
225
49A
51
39
10A
31A

FIG. 11
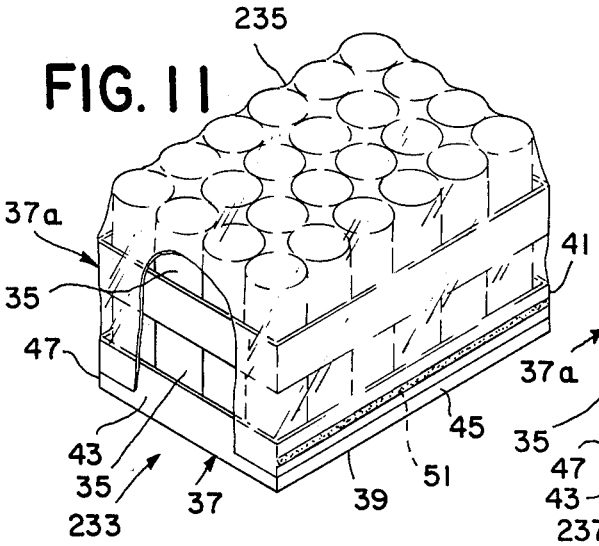
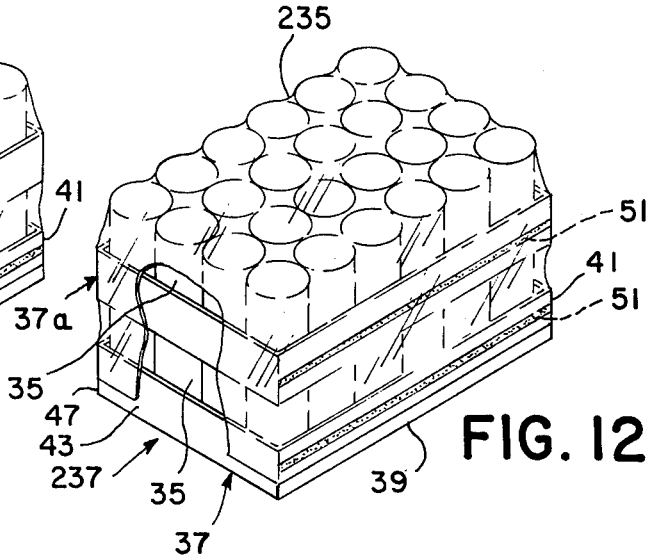
FIG. 12
FIG. 13
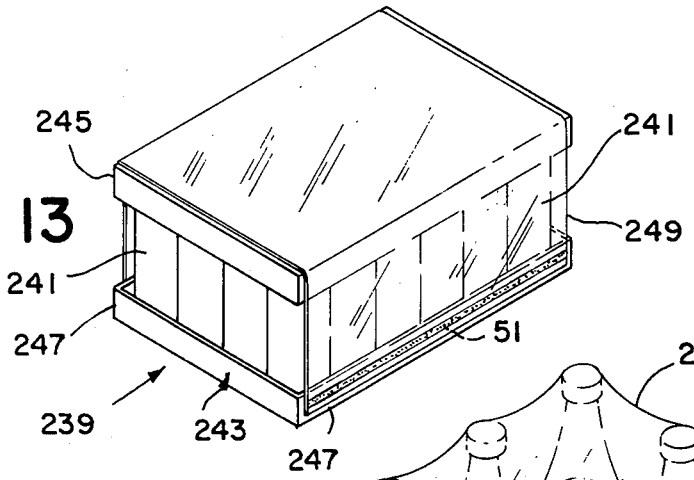
FIG. 14
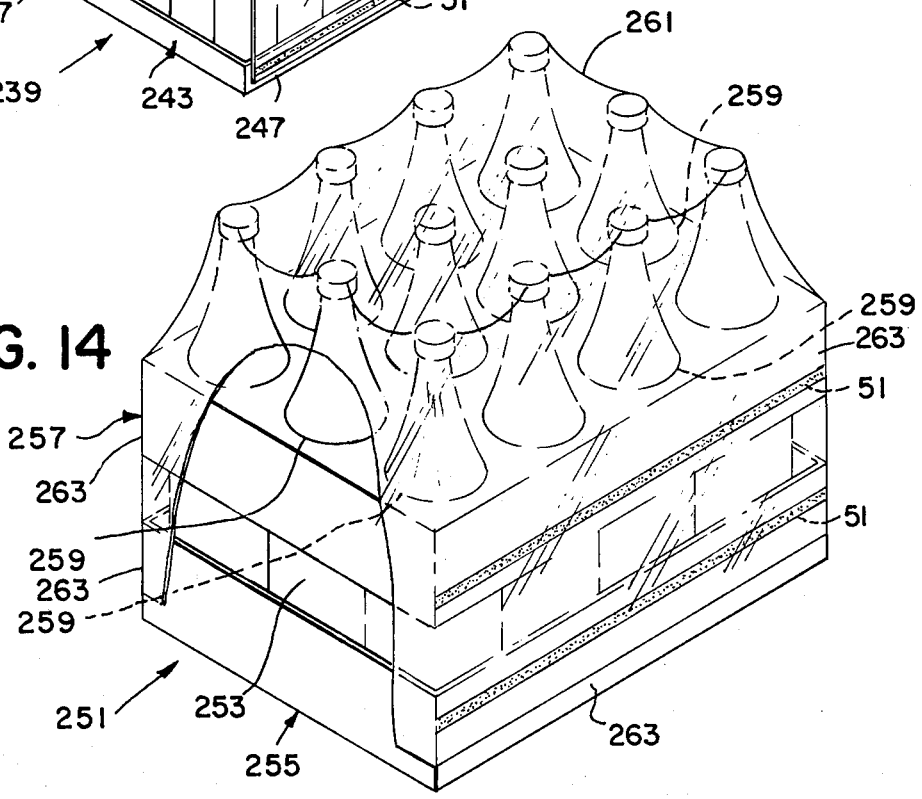

PACKAGE

CROSS-REFERENCE TO RELATED APPLICATIONS

This patent application is a continuation-in-part of my patent application Ser. No. 404,642, filed Oct. 9, 1973, now U.S. Pat. No. 3,890,763.

BACKGROUND OF THE INVENTION

Packages for articles such as cans, bottles, and the like comprising a filled tray having a tubular film-like member around it which is heat shrunk to form a firm package are known. For example, Funkhouser U.S. Pat. No. 3,347,365, which issued on Oct. 17, 1967, discloses such a package and a method of making it which includes the steps of manually or automatically cutting a roll of transparent film-like sheet material into flat blanks, wrapping the blank around a filled tray to surround the filled tray with a transparent tubular or sleeve member having ends which overlap on the bottom of the tray, heat sealing the overlapping ends together whereby the sheet of film material is formed in a tubular form around the filled tray with the opposed ends of the tubular film-like material extending beyond the opposed ends of the articles in the tray, pre-shrinking the open ends of the tubular film-like member around the opposed ends of the articles in the tray, and then heat shrinking the film-like material to hold the articles to the tray and form a rigid package. Instead of wrapping the film-like material around the filled tray, the Funkhouser patent states that an alternative procedure would be to form the film in tubular form without having any longitudinal seams, and insert the filled tray into the seamless tubular sleeve.

Such packages have a number of advantages over the conventional rectangular corrugated paperboard case, including weight savings, lower cost, locking the cans or bottles to the tray so as to prevent relative movement or chime riding, transparency so that the labels on the articles can be seen, and easy removal by slitting the film sheets. Moreover, the heat-shrunk film sheet keeps the articles clean. However, such packages have a number of disadvantages such as the overlapped portion of the film sheet on the bottom of the tray which sometimes hinders the sliding movement of the tray in transporting it from one position to another.

SUMMARY OF THE INVENTION

Accordingly, it is an object of this invention to overcome the disadvantages of the prior art and to provide an improved package. It is another object to provide a package which does not have a film-like material on the bottom of the tray to interfere with sliding of the package, and which is more economical in that it uses less film than conventional heat-shrunk film packages.

These objects are accomplished by providing a package which includes a filled tray, and a film or paper sheet which overwraps the articles in the tray and is attached to opposed walls of the tray by an adhesive.

BRIEF DESCRIPTION OF THE DRAWINGS

FIG. 11 is a view in perspective of a two-tier package of cans constructed in accordance with this invention with an upper tray of cans stacked on a lower tray of cans and with the sheet adhesively attached to the long walls of the lower tray;

FIG. 12 is a view in perspective of a two-tier package of cans similar to FIG. 11 but with the sheet adhesively attached to the long walls of both the upper and lower trays;

FIG. 13 is a view in perspective of a package of tall cans including an inverted top tray positioned on top of the cans to hold them in vertical alignment;

FIG. 14 is a view in perspective of a package of tall bottles including an inverted top tray provided with holes that receive the top of the bottles to hold them in vertical alignment;

DESCRIPTION OF THE PREFERRED EMBODIMENTS

Figure 1A:
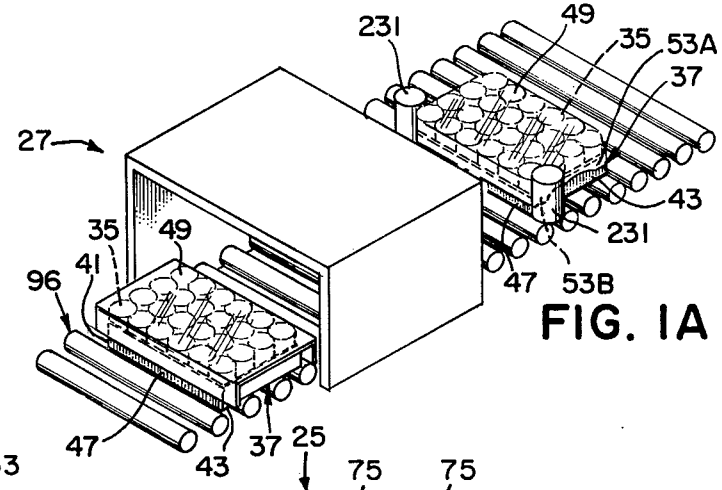
FIG. 1A is a diagrammatic view of a shrink tunnel forming an element of the packaging machine invention.
Figure 1:
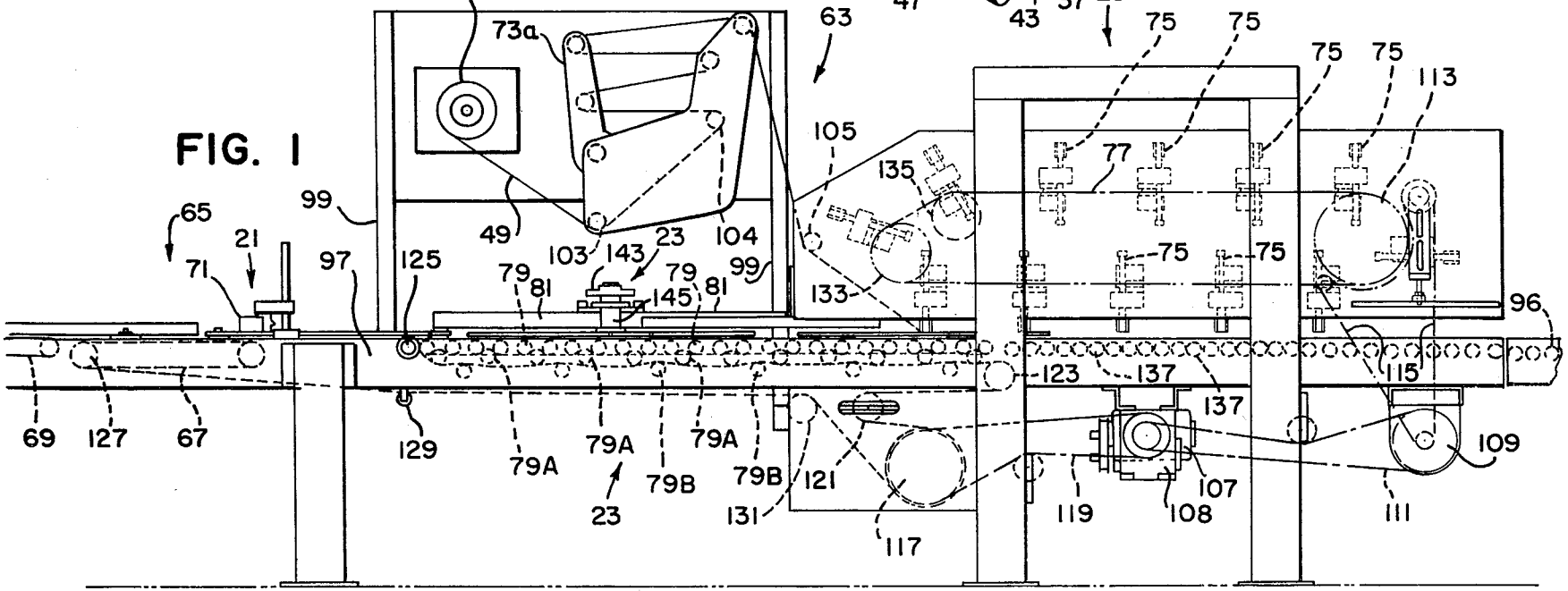
FIG. 1 is a view in side elevation of a packaging machine constructed in accordance with this invention.

Turning now to specific embodiments of the invention selected for illustration in the drawings, there is shown in FIGS. 2A–2D a package 33 for the illustrated cans 35, bottles and the like, comprising a corrugated paperboard tray 37 having a bottom 39 and upstanding walls extending therefrom with a first pair of walls 45, 47 being connected to a second pair of walls 41, 43, a film sheet 49 covering cans 35, and stripes of adhesive 51 connecting opposite ends of film sheet 49 to opposed walls 45 and 47 of tray 37, film sheet 49 usually being heat shrunk to hold cans 35 to tray 37. Film sheet 49 has an inverted U-shape, and forms opposed ends 53 which overlap the sides of cans 35.

The method of packaging articles such as cans 35 into tray 37 comprises the steps of applying adhesive onto the first pair of walls 45 and 47 of tray 37, disposing film sheet 49 against the applied adhesive 51 on walls 45 and 47, compressing the film sheet 49 against applied adhesive 51 on walls 45 and 47 until the adhesive sets, and shrinking sheet 49 to hold the cans 35 to the tray 37. The method also includes the shrinking of film sheet ends 53 to overlap the sides of the cans 35. The method may also include the steps of rotating the tray 37 by 90° so that wall 45 becomes the leading wall and wall 47 becomes the trailing wall, disposing film sheet 49 against the applied adhesive 51 on the leading wall 45, pulling the film sheet 49 tautly over the cans 35 and against the applied adhesive 51 on trailing wall 47, and holding the film sheet 49 against applied adhesive 51 on trailing wall 47.

The method may further include the steps of separating the film sheet between trays by piercing the film sheet 49 by moving two sets 55 and 57 of opposed cutting blades 59 and 61 downwardly through film sheet 49, cutting the film sheet 49 by moving said cutting blade sets 55 and 57 away from each other, and holding the uncut ends 53 of the film sheet in position for cutting while moving said cutting blade sets 55 and 57 away from each other.

The adhesive may advantageously be applied to the walls 45 and 47 by spraying.

The method may also include applying an adhesive onto said second pair of walls 41, 43, heat-shrinking said film sheet onto said second pair of walls adhesive, and compressing the film sheet against said applied adhesive on the second pair of walls 41, 43 after the heat-shrinking.

Turning now to the packaging machine 63 shown in FIGS. 1 through 6 of the drawings, there is shown a case or tray indexing station 65 having an accelerator conveyor belt 67 which moves the filled trays faster than the infeed pacer belt 69 in order to space the trays apart, glue station 21 having spray guns 71 for spraying and adhesive onto the sidewalls 45 and 47 of tray 37, and a constant-tension film-unwind device 73 for disposing film sheet 49 against applied adhesive 51 on walls 45 and 47 and tautly over cans 35. Packaging machine 63 also includes compression station or section 25 having flight bars 75 which travel on chains 77 to move the trays 37 through compression section 25 while compressing the film sheet 49 against the applied adhesive 51 on walls 45 and 47 unitl the adhesive sets. Accelerator belt 67 delivers the trays 37 to power driven rollers 79 which feed the trays 37 to flight bars 75. The cutting blades 55 and 57 separate the film sheet 49 below applied adhesive 51 during the course of travel of the trays 37 through compression section 25, and shrink tunnel 27 shrinks the sheet 49 around the cans 35 to hold the cans to the tray 37 and form the package 33 shown in FIG. 2D. Shrink tunnel 27 also shrinks the opposed ends 53 to overlap the sides of the cans 35 (but not always closed as shown in FIG. 2D).

Between glue station 21 and compression station 25 there is positioned a turning station or section 23 which includes arms 81 that rotate the tray 37 90° so that wall 45 becomes the leading wall and wall 47 becomes the trailing wall.

Means are provided for disposing film sheet 49 against the applied adhesive 51 on leading wall 45, for holding the film sheet 49 against the leading wall 45 applied adhesive 51, for pulling the film sheet 49 tautly over the cans 35 and against the applied adhesive 51 on trailing wall 47, and for holding the film sheet 49 against the trailing wall 47 applied adhesive 51. Such means include power driven rollers 79 which push a tray 37 against the web of film sheet 49 as it is being pulled from constant-tension film-unwind 73 by a preceding tray which is being moved along by a flight bar 75, a next flight bar 75 which holds the film sheet 49 against the leading wall 45 applied adhesive 51, and a succeeding flight bar 75 which pulls the film sheet 49 tautly over the tops of cans 35 and against the applied adhesive 51 on the trailing wall 47 and holds the film sheet 49 against the trailing wall 47 applied adhesive 51. As tray 37 enters compression section 25, the leading cans 35 contact the web of film sheet 49, which is maintained in tension by film-unwind device 73 which pulls taut the web of film from the preceding tray and flight bar 75.

Figures 2, 2A, 2C, 2D:
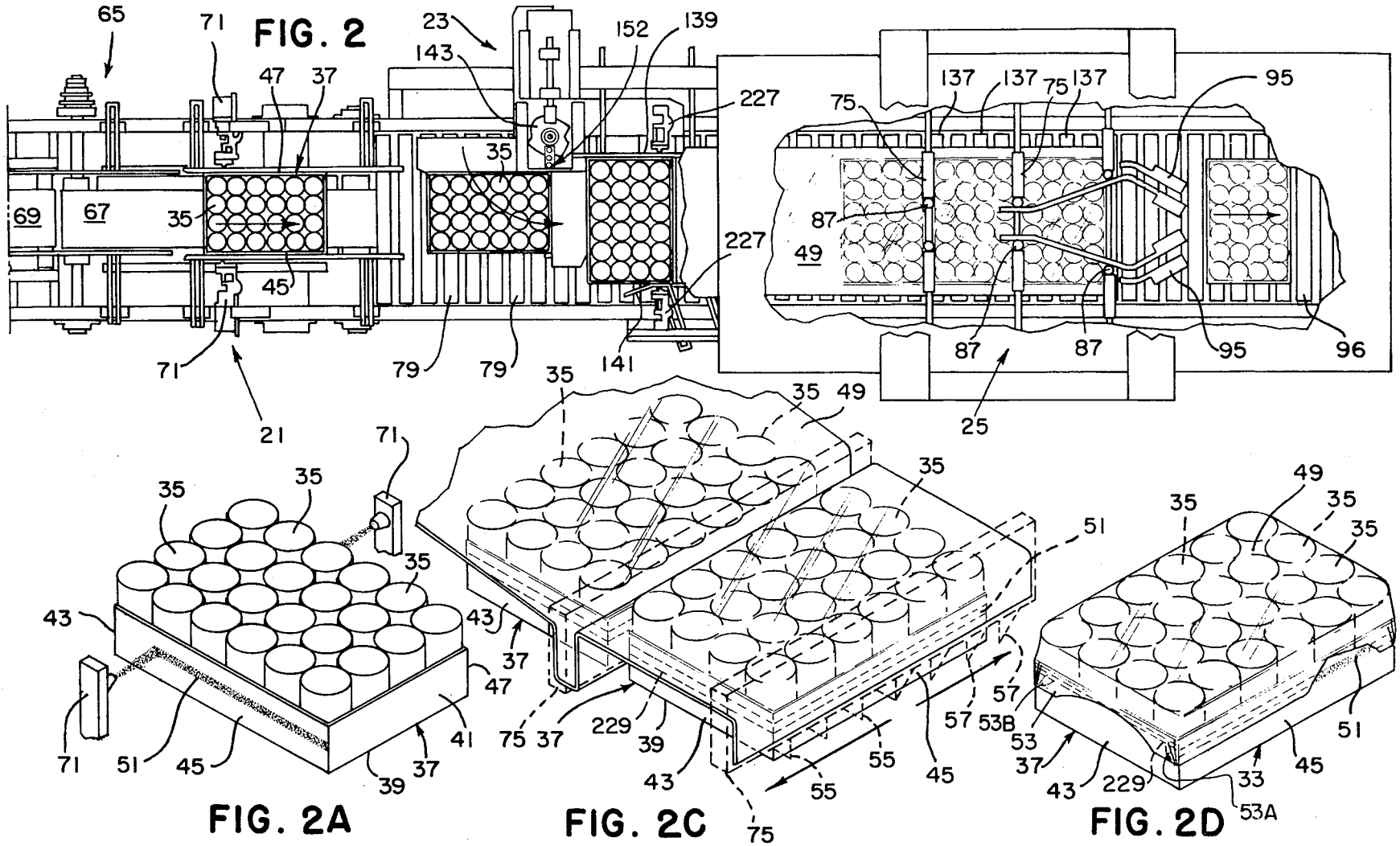
FIG. 2 is a view in top plan of the packaging machine shown in FIG. 1.
FIG. 2A is a view in perspective of a tray filled with cans showing its condition at the glue station indicated by arrow 21.
FIG. 2C is a view in perspective of the condition of the filled trays while in the compression station or section indicated by the arrow 25.
FIG. 2D is a view in perspective of the completed package after it has passed through shrink tunnel 27.
Figure 3:
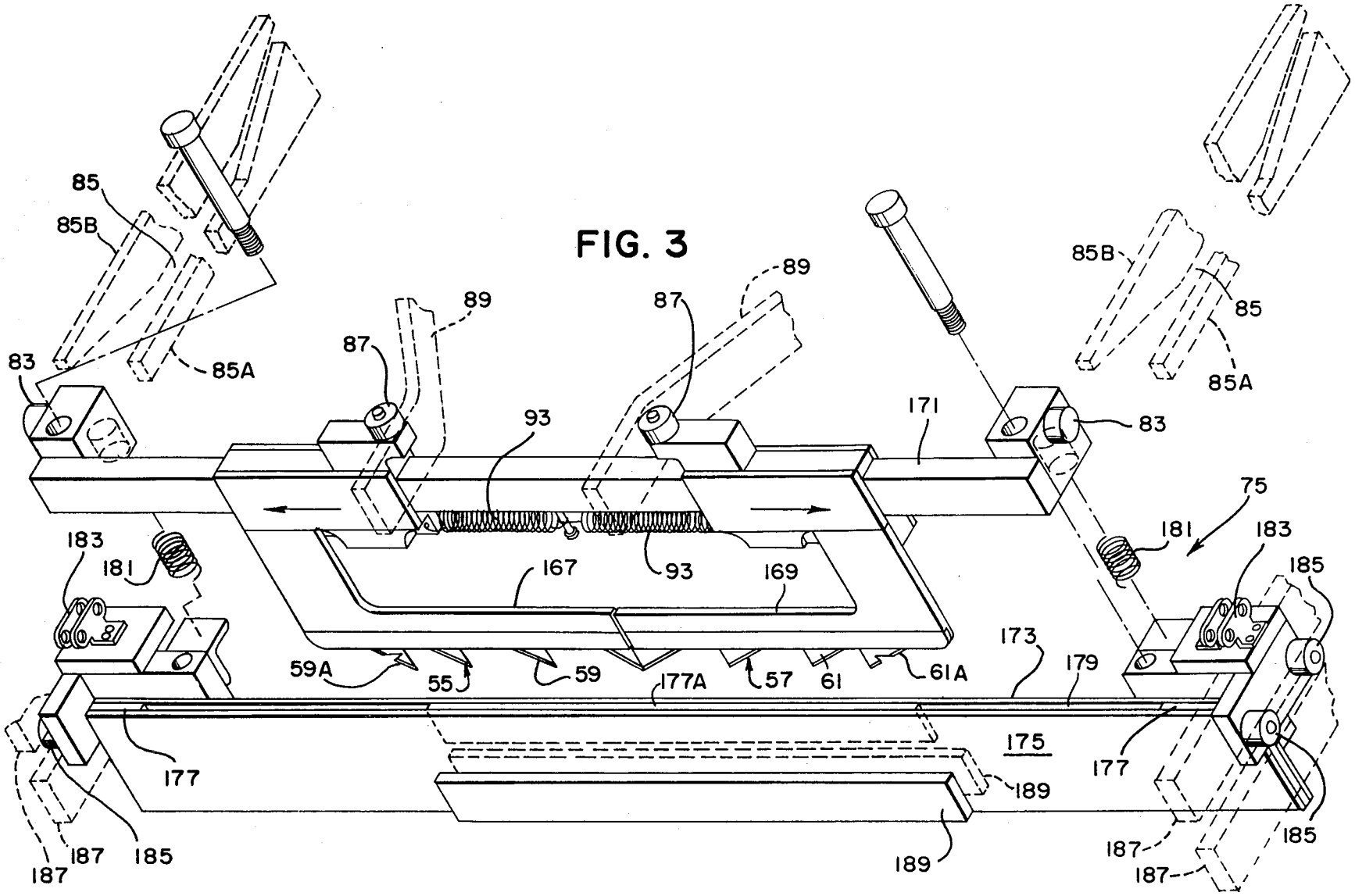
FIG. 3 is an enlarged exploded view in perspective of the cutting mechanism forming a part of this invention.

Means are provided for separating the film sheet 49 between trays 37, and such means, as shown in FIG. 3, includes rollers 83 and cam track 85 formed by guides 85A and 85B for moving cutting blades 59 and 61 in blades sets 55 and 57 downwardly through the film 49 to pierce the film sheet 49 held taut horizontally by the flight bars 75. The film separating means also includes vertical rollers 87 and cams 89 for moving the cutting blades sets 55 and 57 away from each other to cut the film sheet 49, and flat portions 91 (FIG. 3A) on outer blades 59A and 61A for holding and supporting the uncut open ends 53 of the film sheet 49 in position for cutting while moving the cutting blade sets 55 and 57 away from each other. Where these special flats 91 not present the sharp edges 195 might slice through the film 53 and allow it to flop downwardly out of the control of the knives 59A and 61a and so be uncut. Cams 89 move cutting blade sets 55 and 57 away from each other against the action of springs 93. After the film sheet 49 has been cut, cutting blade sets 55 and 57 are moved toward each other by cams 95 (FIG. 2) to normal position. Springs 93 retain blade sets 55 and 57 at their innermost position after leaving cams 89 and 95 and throughout their return travel and until entering upon cams 89 once again. The cutter assemblies are cammed upwardly by the far end of lower bar 85A of cam set 85 (FIG. 6) and are retained in this position by springs 181 until once again rollers 83 enter cams 85.

After the film sheet 49 has been cut, the filled trays 37 and discharged from compression station 25, with flight bars 75 giving them a parting push along downwardly inclined roller conveyor 96 which leads to an interconnecting conveyor which leads to shrink tunnel 27.

Film-unwind device 73 is mounted on frame 97 by unwind stand uprights 99 and includes a roll 101 of film which has its web trained around a nunber of rollers including rollers 103–105, all of which operate as parts of a rotary festooning device which allows the film to be taken smoothly and with constant tension from the roll. Arm 73A moves through an arc and is loaded by a torsion spring about its pivot. Arm 37A also controls a braking device which prevents override of roll 101.

Motor 107 drives a gear box or reducer 108 which in turn drives all the other moving parts by chains 111 and 119. Motor 107 is mounted on frame 97 to drive conveyor belts 69 and 67, and also powers rollers 79 and flight bar chains 77. Motor 107 is connected to an electromagnetic clutch-brake 109 through a gear box 108 by chain 111, and clutch-brake 109 is connected to flight bar sprocket 113 by chain 115. This clutch-brake combination is energized electromagnetically to drive the flight bars 75 and to stop them, when necessary, precisely in proper location to receive another tray load.

The gear box 108 of motor 107 is also connected to conveyor belt sprocket 117 by chain 119. Conveyor belt 67 is trained as follows: around sprocket 117's driving roller, adjustable roller 121, end roller 124, between two layers 79A and 79B of power rollers, intermediate roller 125, end roller 127, return roller 129 and roller drive idler 131.

Flight bar chains 77 are trained around flight bar sprockets 113, 135 and 133. Positioned beneath flight bars 75 are freely turning rollers 137.

As shown in FIG. 2, turning section 23 includes an adjustable guide rail or turning stop 139 at one side of tray travel which stops and guides the wall 41 of the tray at the completion of its 90° turn, and a curved guide rail or deflector 141 which is adjustably mounted at the other side of tray travel to guide the wall 43 of the tray as the tray completes its turn and moves sideways toward flight bars 75.

Figure 2B:
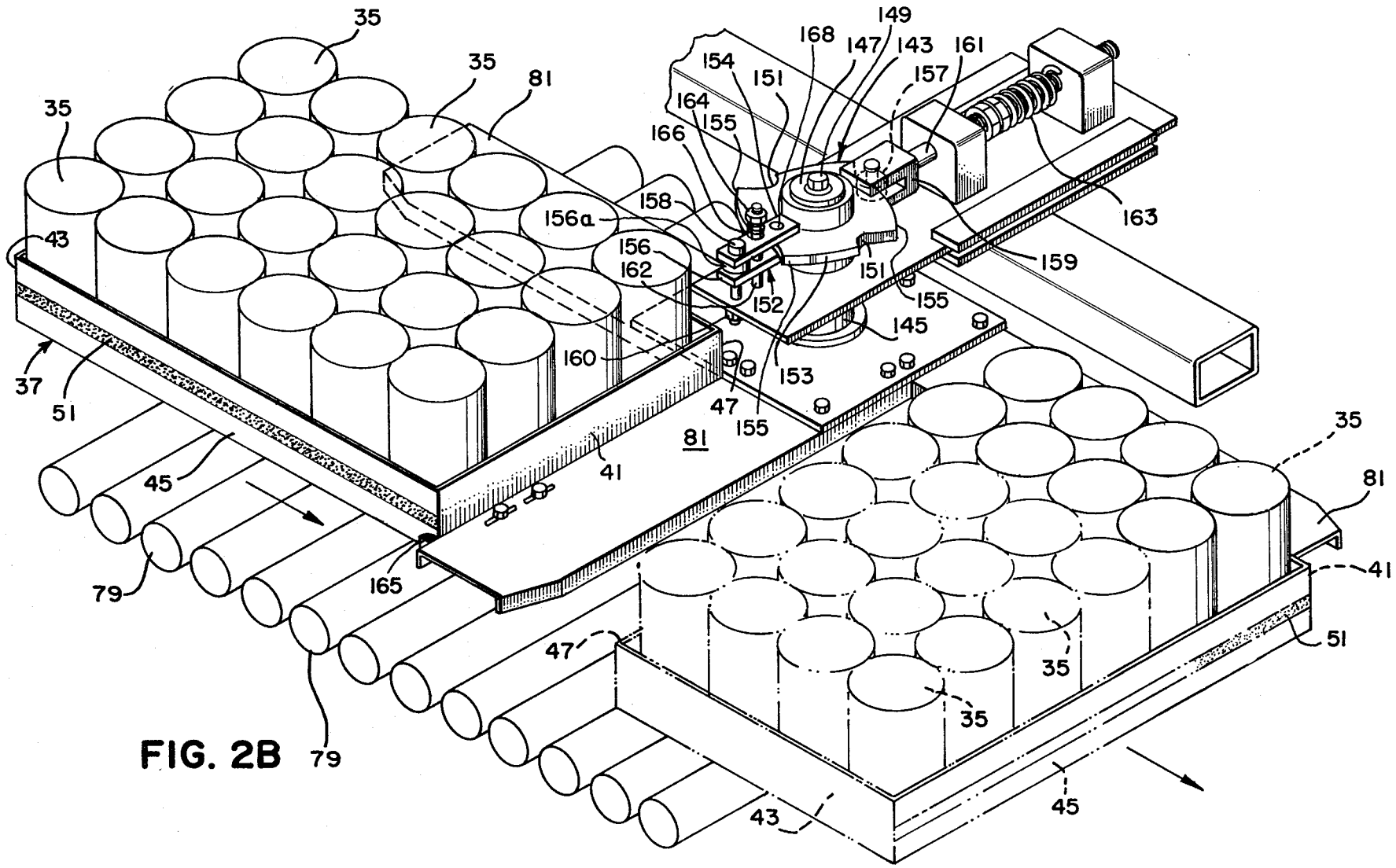
FIG. 2B is a view in perspective showing the condition of the filled trays at the tuning station or section indicated by an arrow 23.

Referring now more particularly to FIG. 2B which is an enlarged view of a portion of the turning section 23, there is shown a turning cam 143 keyed to a shaft extending upwardly from hub 145 and held in place on the shaft by a washer 147 and bolt 149. The circumference of cam 143 includes a series of four notches 151, curved surfaces 153, and circular sections 155.

An indexing cam roller 157 is in contact with the circumferential surfaces of cam 143 and is mounted in a cam follower yoke 159 which extends from a cam follower push rod 161 that is urged forwardly by a spring 165. The interaction of cam 143 and roller 157 is to effect a positioning detent which locates the turnstile at rest in proper position to receive tray 37.

A brake unit 152 is operatively connected to turner cam 143 and includes upper brake arm 154 and lower brake arm 156 with spacer portion 156A mounted on a support plate by a shoulder screw 158 and nut 160, a stud 162 welded to lower brake arm 156 and extending upwardly through a hole in upper brake arm 154 and downwardly through a hole in the support plate, stud 162 having a threaded upper portion with a nut 164 thereon which bears against a spring 166 which acts in relation to spacer portion 156A of arm 156 to urge upper brake arm 154 and its brake pad 168 downwardly against the top surface of turner cam 143, and urge lower brake arm 156 and its brake pad upwardly against the bottom surface of turner cam 143. Accordingly, brake arms 154 and 156 ride freely on shoulder screw 158, and are centered vertically by the spring 166. The lower extension of stud 162 engages a hole in the support plate to act as a torque anchor to prevent brake unit 152 from turning about shoulder screw 158.

Also mounted on hub 145 are four turner arms 81 which are positioned 90° apart and are rotatable with the cam 143. Turner arms 81 have control hooks or fingers 165 adjustably mounted on their ends for catching the sidewall 45 and leading the forward end of tray 37 around during its swing through 90°. The following turner arm 81 will bear on side 47 of tray 37 to cause tray 37 to turn.

In operation of the turning section 23, the advancing filled tray 37 is driven by power rollers 79 into a turner arm 81 within the confines of control finger 165. The forward motion and impact of tray 37 on arm 81 forces roller 157 out of its notch 151 and rotates arm 81, hub 145, and cam 143 so that indexing cam roller 157 moves along curved surface 153. Curved surface 153 displaces roller 157, yoke 159 and push rod 161 away from cam 143 so as to increasingly deflect spring 163 and by so doing insure that arm 81 remains in firm contact with leading wall 41 of tray 37 during the tray turning operation. At some point in the turning operation this reactive force will no longer be required and it is then that curved surface 153 becomes circular section 155. When cam roller 157 reaches the portion 155 of surface 153 which is circular, the rotative cam motion is no longer opposed by the spring imposed force of cam roller 157. When the cam roller 157 leaves circular portion 155 and enters the following notched portion 151 the turner arm 81 snaps quickly to the 90° position to thereby release tray 37 from the control of control hook or finger 165 to prevent the tray 37 from turning more than 90°. The power rollers 79 continue to move the tray 37 into guide rail or turning stop 139 which guides tray 37 into the desired square position together with guide rail or deflector 141 so that sidewall 45 with its applied adhesive 51 now becomes the leading wall of the tray as it moves into contact with the web of film sheet 49.

Figure 4:
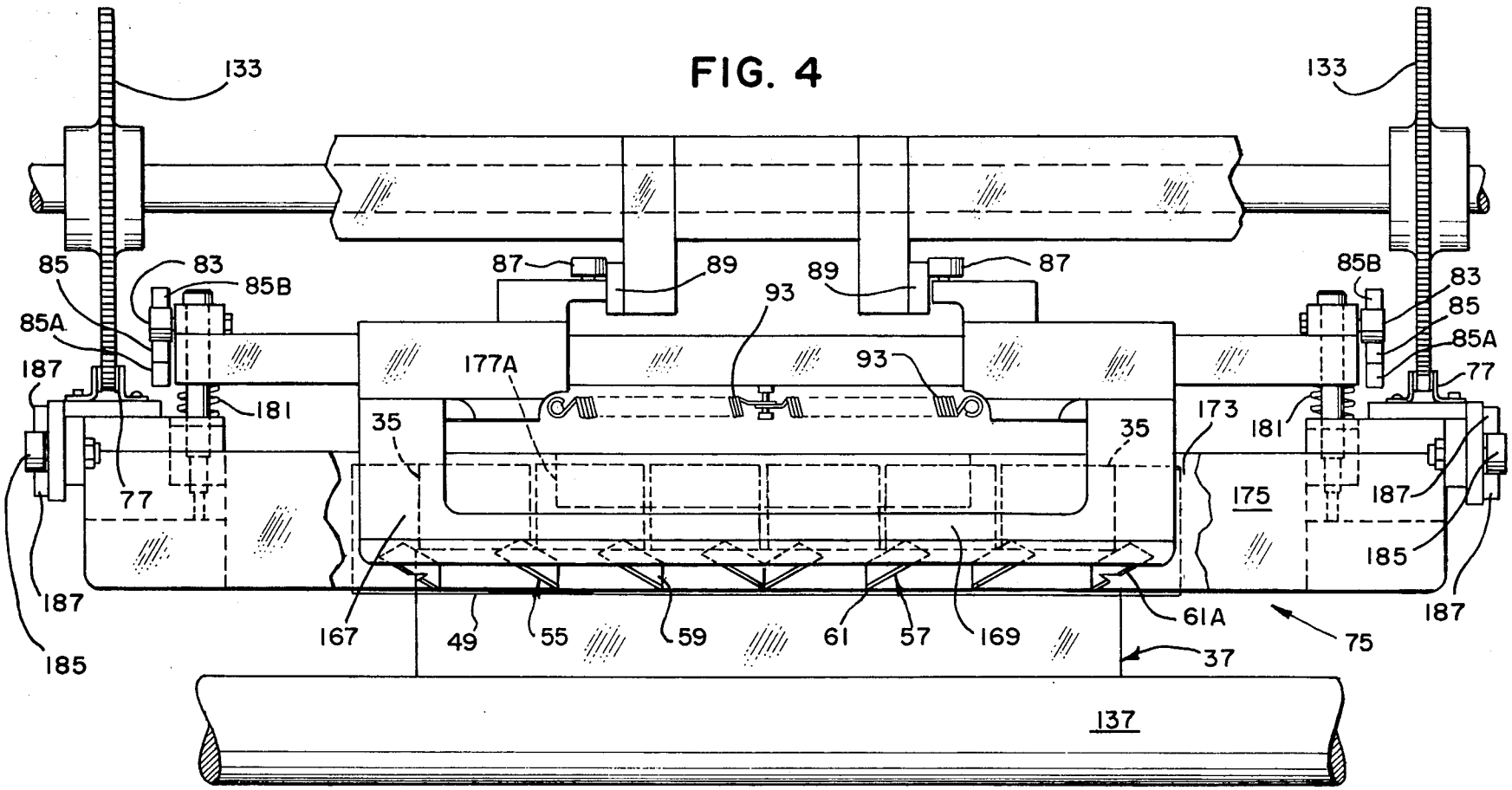
FIG. 4 is a view in front elevation of the cutting mechanism of FIG. 3 with the cutting blades in retracted position.
Figure 5:
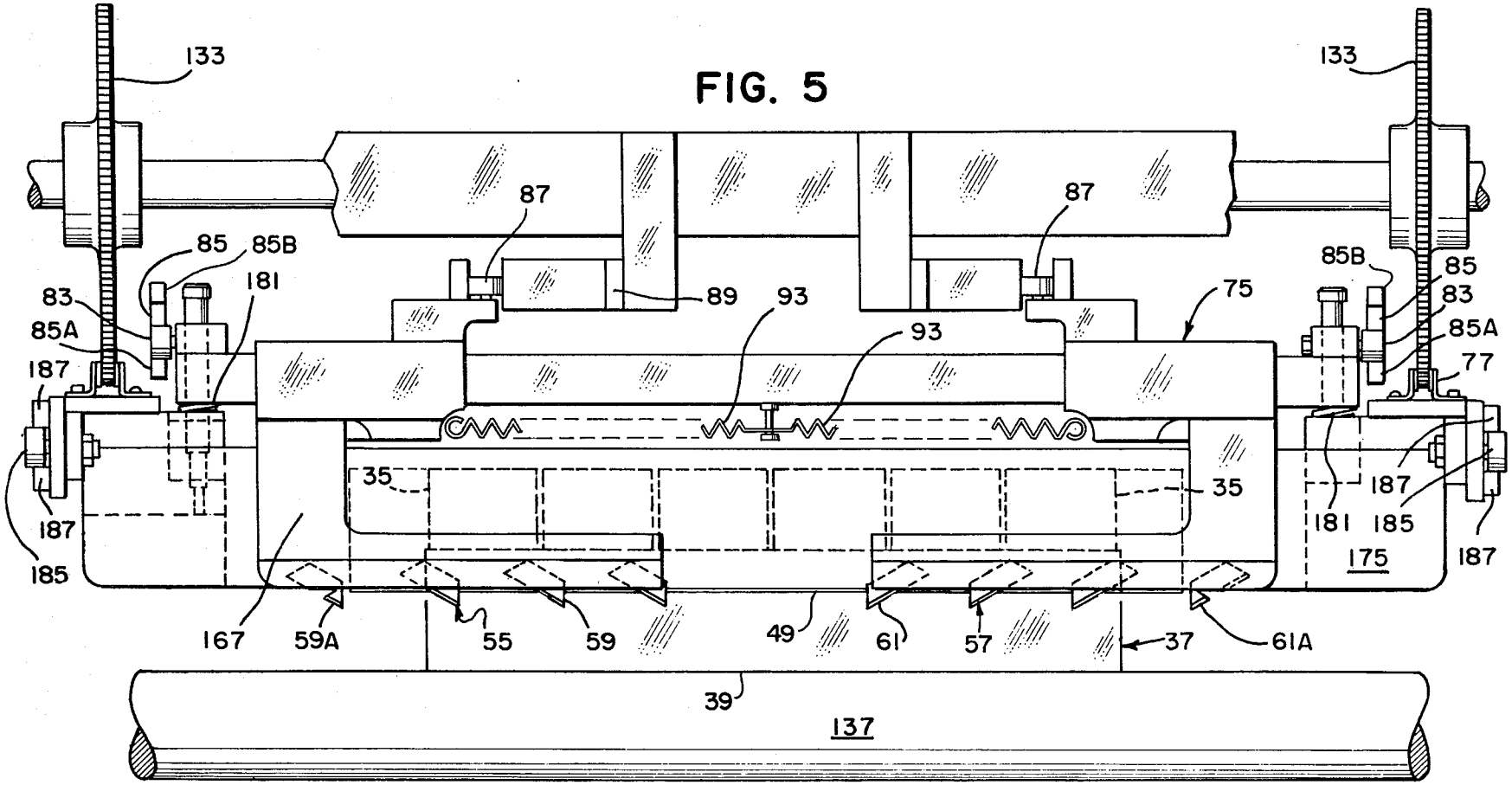
FIG. 5 is a view of the cutting mechanism similar to FIG. 4 but with the cutting blades positioned at the end of the cutting stroke.

Referring now more particularly to FIGS. 3–5, there is shown a film cutting mechanism of the machine. Blade set 55 is mounted in blade holder 167, and blade set 57 is mounted in blade holder 169 and both blade holders are slidably mounted on cutter slide bar 171 and are movable away from each other against the force of horizontal springs 93 by the action of cam rollers 87 bearing against cams 89.

Blade sets 55 and 57 are normally sheathed between flight bar cover plates 173 and 175 which are separated by spacers 177 and spacer 177A to form an opening 179 between the plates that receives cutter blade holders 167 and 169. Cutter blade assemblies are also cammed upwardly by cams 85A (FIG. 3), and inwardly by cams 95 (FIG. 2), as hereinbefore described.

Blade sets 55 and 57 are movable downwardly against the force of vertical springs 181 by the action of cam rollers 83 in cam tracks 85. Flight bar assemblies 75 are attached to the chain links of chains 77 by link connectors 183, and the fight bars 75 are stabilized in their travel by flight bar stability rollers 185 which travel between guide rails 187.

Compression pads 189 are shown mounted on the flight bar cover plates 173 and 175. Such compression pads may be added or removed to accomodate small differences in tray size, such as one-half inch, without removing the flight bars from the chains 77 and reattaching them at a different spacing between them.

FIG. 4 shows the cutting mechanism with the blade sets 55 and 57 in normal sheathed position, and FIG. 5 shows the cutting mechanism at the completion of the cutting stroke with the cutting blades extending below flight bar cover plates 173 and 175 and extending away from each other against the force of horizontal springs 93.

Figures 3A, 8, 9, 10, 10A:
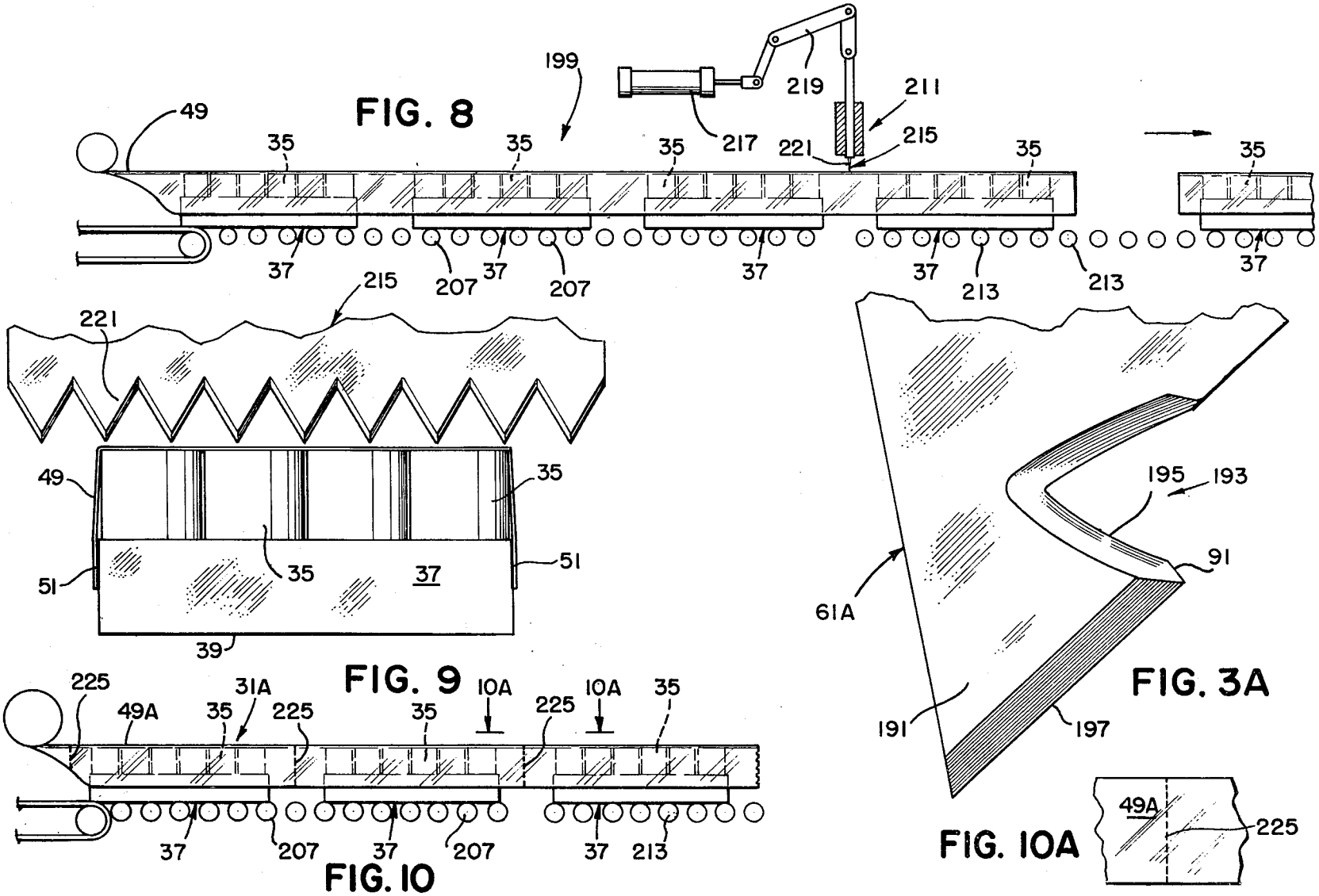
FIG. 3A is an enlarged view of one of the outside cutting blades.
FIG. 8 is a diagrammatic view in side elevation of the embodiment of FIGS. 7, 7A, and 7B.
FIG. 9 is a partial view in elevation of a slicing knife adapted for use with the embodiment of FIG. 8.
FIG. 10 is a view of an embodiment of the invention similar to that of FIGS. 7–8, but which utilizes a film sheet that is perforated at spaced intervals.
FIG. 10A is a partial view in top plan of FIG. 10 showing the preferred film sheet.

FIG. 3A shows an enlarged view of cutting blade 61A and includes body portion 191, notch 193, notch cutting edge 195 which cuts the film sheet as the blade 61A is moved horizontally, and straight cutting edge 197 which pierces film sheet 49 as blade 61A is moved downwardly. Between cutting edges 193 and 197 is an unsharpened flat portion 91 which supports the portion of film sheet 49 which extends outwardly from tray 37 and leads it upwardly into notch 193 as blade 61A moves horizontally through its cutting motion. In other words, flat portion 91 cams the loose ends 53 of film sheet 49 toward the sharp notch cutting edge 195.

Figure 6:
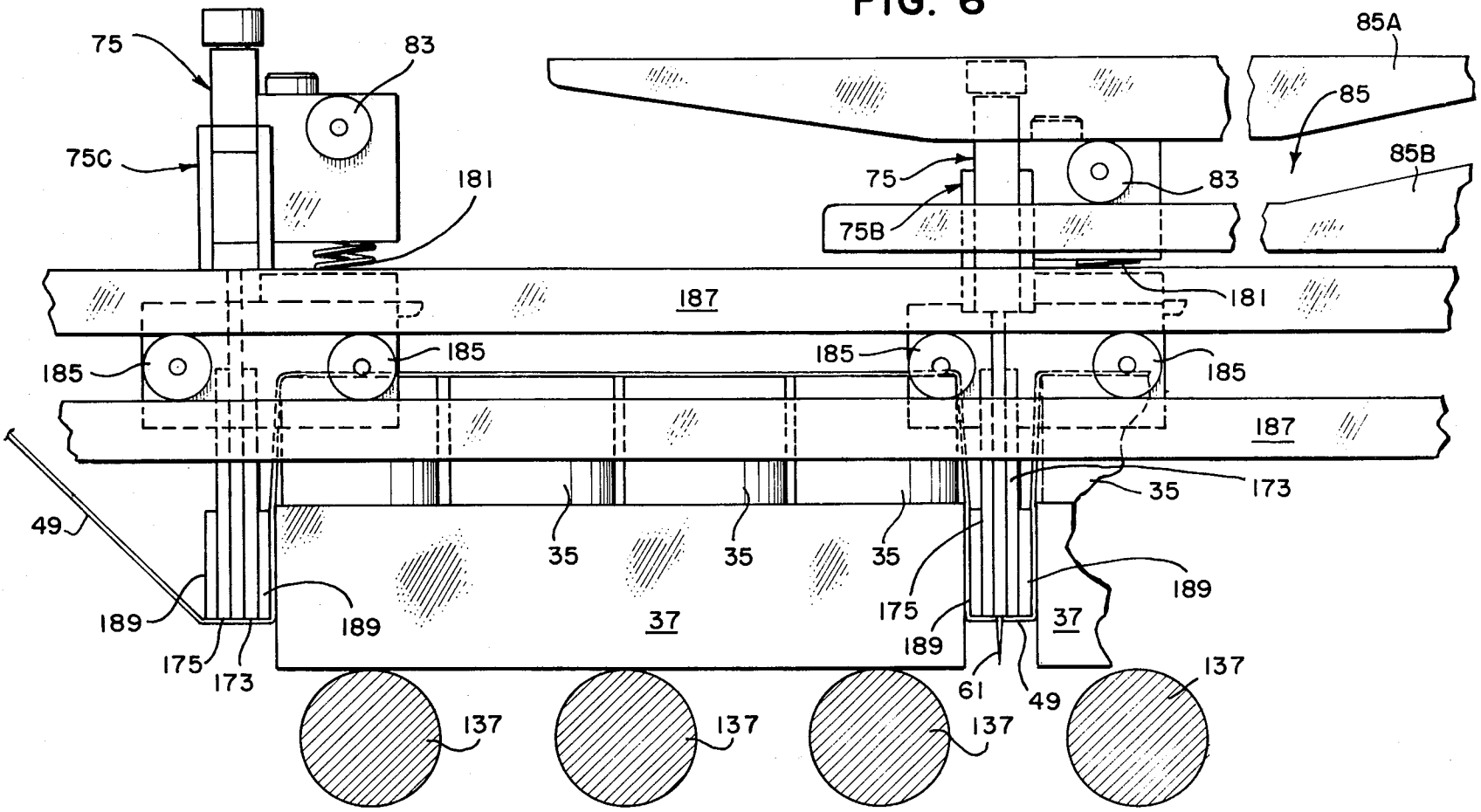
FIG. 6 is a partial view on an enlarged scale showing the condition of the filled tray in compression section 25.
Figure 7:
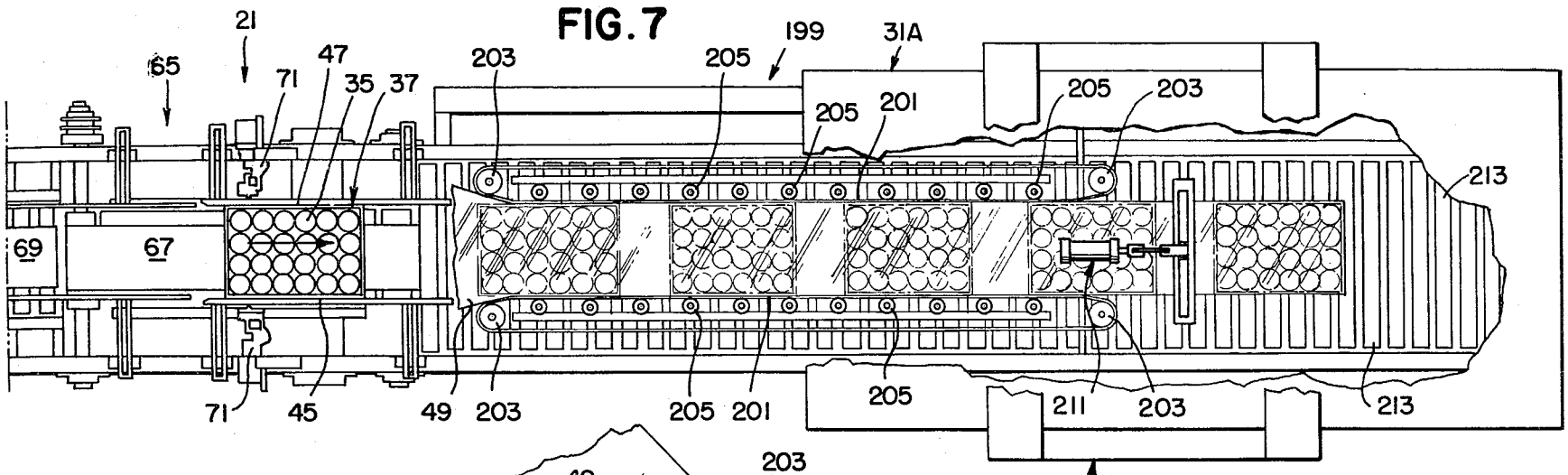
FIG. 7 is a view in top plan similar to FIG. 2 but showing an alternative embodiment of the packaging machine invention.
Figure 7C:
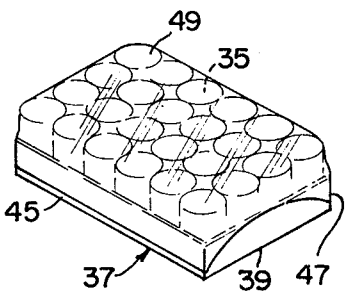
FIG. 7C shows the completed package after being discharged from shrink tunnel 27.
Figure 7B:
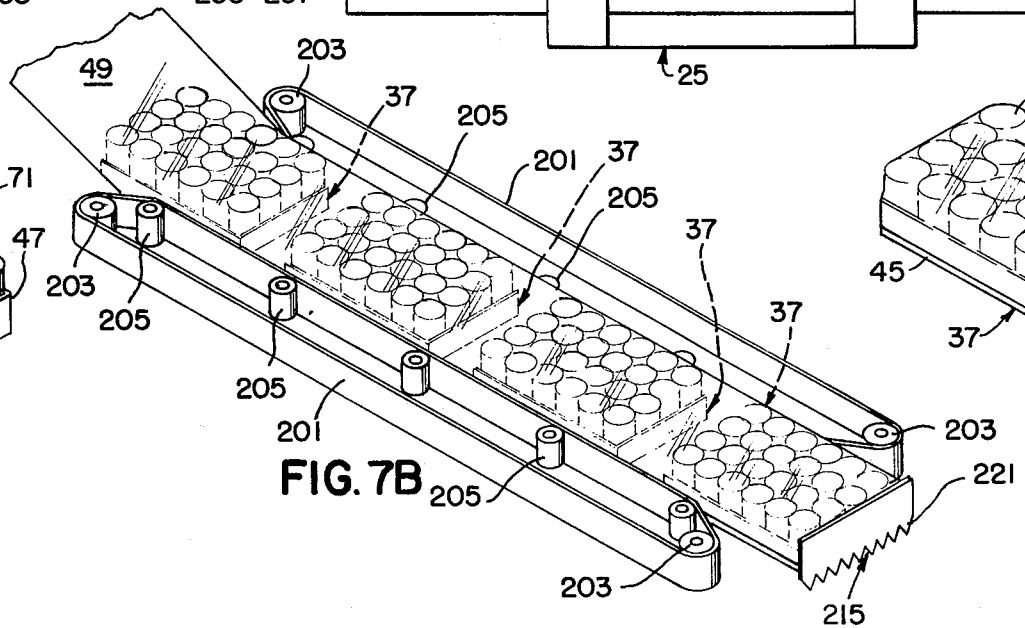
FIG. 7B is a view in perspective showing the condition of the advancing filled trays as they are being overwrapped by a film sheet as they enter compression section or station 31.
Figure 7A:
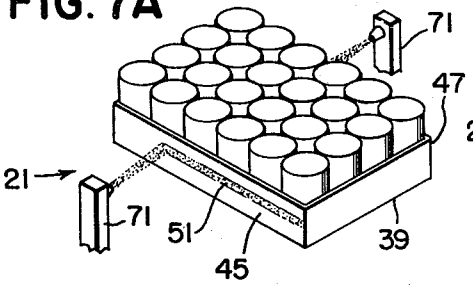
FIG. 7A is a view in perspective showing the condition of the filled tray in the glue station.

FIG. 6 is a view in side elevation which illustrates a leading flight bar assembly 75B with the knife blades having pierced film sheet 49 and extending below flight bar cover plates 173 and 175, having been urged to this position by the action of roller 83 being moved downwardly in cam track 85. A following flight bar assembly 75C shows no cutting blades extending below plates 173 and 175 because they are held in upward sheathed position by the action of spring 181.

Turning now to the embodiment of the invention shown in FIGS. 7, 7A, 7B and 7C, there is shown a packaging maching 199 which includes tray indexing station 65 with pacing belt 69 and accelerator belt 67, glue station 31 with horizontal adhesive applicators 71, and a compression station or section 31A which includes a vertical compression belt 201 positioned on each side of the advancing trays 37 to press film sheet 49 against the applied adhesive 51 on sidewalls 45 and 47. Belts 201 are trained around end rollers 203 and are pressed toward each other by spring-backed rollers 205 or other suitable pressuring means.

FIG. 8 shows machine 199 in side elevation with belts 201 omitted for clarity. In machine 199, the tray 137 is not turned 90°. Trays 37 is driven over idler rollers 207 by side belts 201 which are driven by a clutch-brake to start and stop as trays feed into them. This action spaces the cases apart as desired. During pause, film cutting mechanism 211 slices through the film 49 to release the outgoing tray to driven rollers 213. Film cutting mechanism 211 includes a film separating or severing unit 215 which is vertically reciprocated by an air cylinder 217 and connecting linkage 219. FIG. 9 shows a segmented slicing knife 221 which is adapted for use in film severing unit 215. Also, a hot wire may be used as the severing device in unit 215.

Another method of packaging articles such as cans 35 into tray 37 is to provide a film sheet 49A (FIGS. 10, 10A) having a line of perforations 225 across the sheet at spaced intervals therealong. In this method, referring to FIG. 10, the trays 37 are fed to a tray indexing station as in the other embodiments of the invention where accelerator belt 67 separates the trays by speeding tray movement. Then the walls of the trays are sprayed with adhesive at a glue station, and opposite sides of film sheet 49A are applied to the strips of adhesive as the trays enter compression station 31A which includes compression belts 201 which press the film sheet 49A against the adhesive 51 on sidewalls 45 and 47. In this embodiment, the belts 201 are powered and move the trays through the compression section 31A while the adhesive sets. Then belts 201 deliver the trays to rollers 213 which are powered and which increase the speed of the trays 37 emerging from compession section 31 so as to snap film sheet 49A at perforations 225 and thereby detach the film sheet on the emerging tray 37 from the film sheet on the following tray. The tray 37 is then conveyed to shrink tunnel 27 where the film sheet 49A is heat shrunk around the cans 35 to form a rigid package.

Film sheet 49 may be polyvinylchloride, polyethylene, polypropylene, and the like, so long as the film sheet has heat shrinking or resilient characteristics to tightly compact the articles and trays together. Nonshrinking film and paper can also be run through the machines.

The film at short walls 41, 43 may be open, or they may be closed if desired. To close the film over short walls 41, 43, a pair of spray guns or applicators 227 are mounted adjacent to turning section 23 (FIG. 2) so as to apply a stripe 229 along the short walls 41, 43 of tray 37. Adhesive stripes 229 are still warm in the shrinking tunnel 27 and as the ends 53 of the films shrink, they will contact adhesive stripes 229 and form a bond therewith. As the trays 37 emerge from shrink tunnel 27, a pair of spring-loaded rollers 231 positioned on both sides of the exit from the shrink tunnel operate to flatten out the rough ears of the film ends 53 as the tray emerges from the shrink tunnel, and press ends 53 against glue stripes 229 to form a better bond.

Even when adhesive stripes 229 are not applied to short walls 41, 43 of the tray, the pressure of rollers 231 causes the hot, shrunken ends 53 to adhere to walls 41, 43. Also, the heat shrinking of ends 53 is not uniform and forms wrinkled puffy ears 53A and 53B which stick out and are rather unsightly. The rollers 231 press ears 53A and 53B against the tray walls, flatten them out, and gives the package a better appearance.

Film sheet 49 is conventionally made so that it has more stretch in the machine, or longitudinal direction of the film sheet than in the transverse direction of the film sheet. Accordingly, in the preferred embodiment of the invention illustrated in FIGS. 1–6, the film sheet 49 shrinks to a greater degree across the tray from long wall 45 to wall 47, than it does in the transverse direction from short wall 41 to wall 43. Also, the film ends 53 shrink faster than other portions of film sheet 49 because there is nothing to hold film ends 53 against shrinking.

The package of the present invention has the advantage of using only about one-half as much film sheet as conventional tube-type packages, and the glue cost is negligible.

The inventive package is easier to convey because there is no film underneath it that might wrinkle up when going through the heat tunnel 27 or over conventional conveyor systems. Also, there is no chance of the heated film sticking to the conveyor rollers because there is no film underneath the inventive package.

Another advangtage of the invention is that the glue joint between the film sheet 49 and the tray 37 is easy to apply and set, whereas welding joining or overlapping edges of a film sheet can be a rather difficult operation. Also, in palletizing, the paper-to-film joint of the present invention is less fragile than the film-to-film joint in pallet loads as transported.

Glue station 21 and spray gun 71 may be constructed in accordance with Huntingdon Industries Incorporated U.S. Pat. Nos. 3,152,923; 3,198,435; and 3,395,694 which are incorporated herein by reference.

When being palletized the bottom surfaces of the paper trays present fewer handling problems than do the bottom surfaces of fully plastic wrapped packages. As stacked in a pallet load, the fibre board trays sitting upon the film overwrap of underneath packs have less tendency to slip and slide than do either film against film or paper against paper stacks.

Turning now to the specific embodiments of the invention selected for illustration in FIGs. 11–17 of the drawings, there is shown in FIG. 11 a view in perspective of a two-tier package 233 comprising a tray 37 having a bottom 39 and upstanding walls 41, 43, 45, and 47 extending therefrom with a first pair of spaced-apart walls, long walls 45, 47, connected together by a second pair, short walls 41, 43, with tray 37 being filled with cans 35. A second, upper tray 37*a*filled with cans 35 is stacked on top of first tray 37, and a sheet 235 of heat-shrunk film is connected at its ends to achieve stripes 51 on long walls 45, 47 of lower tray 37 to cover cans 35 of upper tray 37*a* and hold the cans of both trays in a tight package.

After filling the trays with cans, the method of packaging the cans 35 into package 233 of FIG. 11 comprises the steps of positioning the first tray 37, stacking second tray 37*a* on top of first tray 37, applying a stripe 51 of adhesive onto long walls 45, 47 of first tray 37, disposing sheet 235 against the applied adhesive stripes 51 on long walls 45, 47 and over the cans 35 in upper tray 37*a,* and compressing sheet 235 against the adhesive stripes 51 on walls 45, 47 until the adhesive sets. The method may also include the step of heat shrinking the film sheet 235 onto the cans 35 in upper tray 37*a* by passing the package 233 through the shrink tunnel 27 shown in FIG. 1A.

A two-tier package 237 is shown in FIG. 12 and is similar to the package 233 shown in FIG. 11 except that the film sheet 235 is also adhesively attached to the long walls 45, 47 of upper tray 37*a* along adhesive stripes 51. The method of making package 237 is the same as the method of making package 233, except that it includes the additional steps of applying an adhesive stripe 51 onto long walls 45, 47 of upper tray 37*a* before covering cans 35 with sheet 235, disposing sheet 235 against the adhesive stripes on upper tray 37*a,* and compressing sheet 235 against the adhesive stripes on upper tray 37*a* until the adhesive sets.

FIG. 13 discloses a package 239 of tall cans 241 disposed in a bottom tray 243 and covered by a shallow inverted top tray 245 which keeps the tall cans in vertical alignment. The walls of trays 243 and 245 need not be as high as the walls of trays 37 because the walls of top tray 245 help the walls of bottom tray 243 to hold the cans in vertical alignment. An adhesive stripe 51 is applied to the long walls 247 of bottom tray 243, and a sheet 249 is connected to strpes 51 of walls 247 and covers the inverted top tray 245 to hold the cans 241 in a tight package. The method of making package 239 includes the steps of positioning inverted top tray 245 on top of the cans 241, applying adhesive stripes 51 to both long walls 247 of bottom tray 243, disposing the sheet 249 over the top tray 245 and cans 241 and against adhesive stripes 51, and compressing the sheet against adhesive stripes 51 until the adhesive sets. Sheet 249 may be made of heat-shrinkable film, stretch film or plain paper. When sheet 249 is made of heat-shrinkable film, the package 237 is passed through a shrink tunnel 27 to shrink the film sheet 249 and create a tight package. Sheet 249 need not extend outwardly of the short walls of shallow trays 243 and 245 because the short walls hold the cans from tilting sideways.

FIG. 14 discloses a package 251 of tall bottles 253 loaded in a bottom tray 255 and covered by an inverted top tray 257 positioned on top of bottles 253 to keep them in vertical alignment, with inverted top tray 257 being provided with holes 259 that receive the tops of bottles 253. A film sheet 261 covers the tops of the bottles, and is preferably heat-shrunk to hold the bottles in a tight package. The ends of sheet 261 are adhesively attached to adhesive stripes 51 on long walls 263 of trays 255 and 257. The method of making the package 251 includes the steps of loading the bottles 253 into bottom tray 255, placing inverted top tray 257 over the tall bottles 253 so that the tops of the bottles project through holes 259, applying adhesive stripes to long walls 263 of both trays, disposing sheet 261 over the bottles 253 and against the stripes 51, compressing the sheet 261 against stripes 51 until the adhesive sets, and heat-shrinking sheet 261 to form a tight package. Instead of inverted top tray 257, the tops of bottles 253 could be held in place by a sheet of corrugated paperboard having holes that receive the tops of the bottles.

Figure 15:
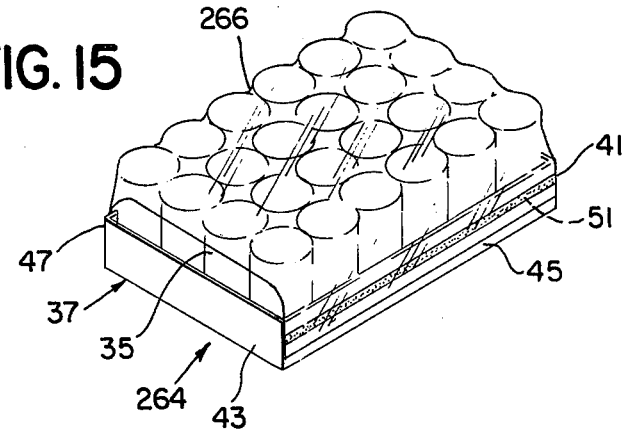
FIG. 15 is a view in perspective of a package of cans wherein the sheet is made of stretch film that is stretched over the cans and does not have to be heat shrunk around the cans.

FIG. 15 discloses a package 264 of cans 35 in a tray 37 with a clear sheet 266 of stretch film attached to adhesive stripes 51 on long walls 45, 47 and stretched over cans 35 to form a tight package. Sheet 266 extends outwardly past the center of the outer rows of cans to hold them against sidewise tilting, but need not extend outwardly past the side edges, although it is preferred that sheet 266 be wide enough to bear against the sidewalls of the outer rows of cans. The method of making package 264 omits the step of heat-shrinking since the sheet 266 is of stretch film and is stretched over the cans to hold them tightly.

Figure 16:
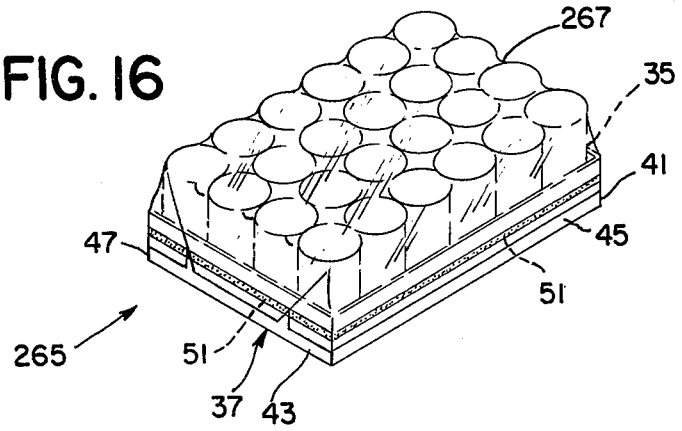
FIG. 16 is a view in perspective of a package of cans with stretch film or shrink film extending outwardly from the short walls of the tray, tucked in, and adhesively connected to the short walls as well as to the long walls.

FIG. 16 disclosed a package 265 of cans disposed in a tray 37 and covered by a sheet 267 which is made of stretch film and which is connected to long walls 45, 47 along adhesive stripes 51. The stretch film sheet 267 extends outwardly from short walls 41, 43 and is tucked in and attached to the short walls along adhesive stripes 51. The method of making package 265 includes the steps of applying adhesive stripes 51 to short walls 41, 43, making a tuck in the outstanding sides of sheet 267 and folding the sheet sides into contact with and compressing the sides of sheet 267 against the adhesive stripes 51 on the short walls. Film sheet 267 may be made of heat-shrinkable film, if desired, in which case the package 265 is then heat shrunk by passing it through shrink tunnel 27.

Figure 17:
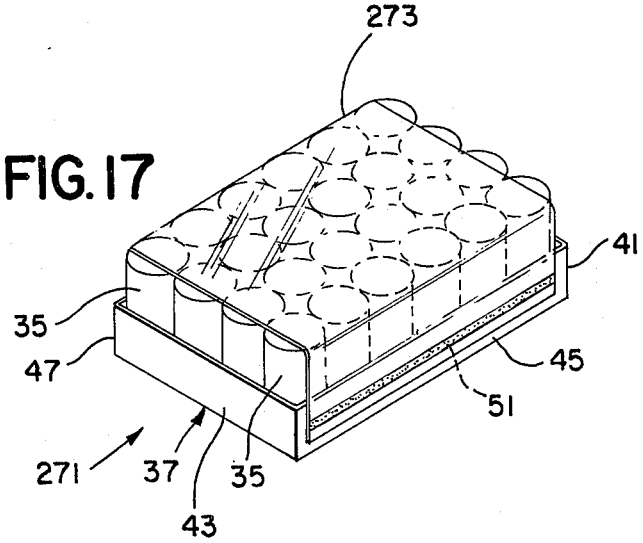
FIG. 17 is a view in perspective of a package of cans with the sheet being made of plain paper.

FIG. 17 discloses a package 271 of cans 35 loaded into a tray 37 with a sheet 273 connected to adhesive stripes 51 on long walls 45, 47 and holding the cans in a tight package. The sides of sheet 273 do not extend outwardly from short walls 39, 43, and sheet 273 may be of plain brown paper rather than of stretch or heat-shrink film.

The double tier packages 233 and 237 are especially advantageous in the food industry, for example, for providing a package of 48 cans of dog food or soup. The packages are neat, clean, and provide an attractive display for supermarket food stores and have the added advantage, where clear film is used, of not requiring that the package be unpacked and the cans removed before the merchandise can be displayed on the floor of the market. The four-sided adhesive stripes of FIGS. 2D and 16 have the added advantage of inhibiting pilfering of a can since the sheet must be pierced before a hand can reach a can and remove it from the package.

I claim:

1. A package for articles such as cans, bottles, and the like, comprising a tray having a bottom and upstanding walls extending therefrom with a first pair of spaced-apart walls connected together by a second pair, a sheet covering said articles, and adhesive means connecting the sheet to the first pair of walls to hold the articles to the tray, said film sheet being pressed against said adhesive and said walls to effect an adhesive connection prior to heat shrinking said film sheet, an inverted top tray positioned on top of the articles to keep the articles in vertical alignment, the inverted top tray being covered by said sheet, said top tray having a bottom resting on the top of the articles with walls extending downwardly from said bottom and surrounding said articles to keep the articles confined within said walls to hold the articles against tilting, said inverted top tray being provided with holes that receive the tops of the articles, said sheet covering the tops to the articles.

2. A method of packaging articles such as cans, bottles, and the like, in trays having a bottom and upstanding walls extending therefrom with a first pair of spaced-apart walls connected together by a second pair, comprising the steps of positioning a first tray filled with articles, stacking a second tray filled with articles on top of the first tray, applying a stripe of adhesive onto said first pair of walls of said first tray, disposing a sheet against said applied adhesive on said walls and over said articles, and compressing said sheet against said applied adhesive on said walls until the adhesive sets, positioning an inverted top tray on top of the articles to keep the articles in vertical alignment before disposing the sheet over said articles, said inverted top tray being provided with holes adapted to receive the tops of the articles, and including the step of placing the inverted top tray over the articles so that the tops of the articles project through the tray holes.

* * * * *